US008621712B2

(12) United States Patent
Pate, Jr.

(10) Patent No.: US 8,621,712 B2
(45) Date of Patent: Jan. 7, 2014

(54) SELF CLOSING INTERNAL HINGE

(76) Inventor: Joseph Pate, Jr., Hamilton, OH (US)

( * ) Notice: Subject to any disclaimer, the term of this patent is extended or adjusted under 35 U.S.C. 154(b) by 0 days.

(21) Appl. No.: 13/573,405

(22) Filed: Sep. 13, 2012

(65) Prior Publication Data

US 2013/0097806 A1 Apr. 25, 2013

Related U.S. Application Data

(63) Continuation-in-part of application No. 12/804,459, filed on Jul. 22, 2010, now abandoned.

(51) Int. Cl.
*E05F 1/14* (2006.01)

(52) U.S. Cl.
USPC ..... 16/285; 16/280; 16/378; 16/75; 49/326

(58) Field of Classification Search
USPC ..... 16/280, 285, 277, 295, 299, 304, 307, 16/308, 309, 72, 75, 76, 379; 49/381, 386, 49/388, 390, 397, 398, 49, 326, 501
See application file for complete search history.

(56) References Cited

U.S. PATENT DOCUMENTS

| | | | | | |
|---|---|---|---|---|---|
| 244,539 | A * | 7/1881 | Boyden et al. | ..... | 16/285 |
| 962,330 | A * | 6/1910 | Fischer | ..... | 16/279 |
| 1,236,536 | A * | 8/1917 | Boyd | ..... | 16/285 |
| 1,611,238 | A * | 12/1926 | Sanborn | ..... | 16/75 |
| 2,774,117 | A * | 12/1956 | Eckel | ..... | 49/397 |
| 3,411,241 | A * | 11/1968 | Harmon | ..... | 49/386 |
| 3,510,986 | A * | 5/1970 | Berkowitz | ..... | 49/386 |
| 4,122,630 | A * | 10/1978 | Parisien | ..... | 49/386 |
| 4,434,524 | A * | 3/1984 | Gilchrist | ..... | 16/250 |
| 4,646,491 | A * | 3/1987 | Munch | ..... | 52/207 |
| 5,606,773 | A * | 3/1997 | Shappell | ..... | 16/298 |
| 7,401,381 | B2 * | 7/2008 | Konja et al. | ..... | 16/285 |
| 7,516,519 | B2 * | 4/2009 | Talpe | ..... | 16/316 |
| 2006/0112515 | A1 * | 6/2006 | Konja et al. | ..... | 16/284 |
| 2007/0136991 | A1 * | 6/2007 | Huang | ..... | 16/307 |

* cited by examiner

*Primary Examiner* — Emily Morgan

(57) ABSTRACT

A self closing enclosed hinge is placed within the tubular structure of a gate. The inventive hidden hinge cannot physically smash fingers. An internal axle physically holds together a first gate hinge connector piece which receives the upper part of the gate, an upper stationary hinge piece, and a midsection outer tubular section, which contains a bushing and a spiral spring to return the gate to a closed position. This internal axle joins the lower stationary hinge piece with the second gate hinge connector piece. The second gate hinge connector piece receives lower part of workpiece gate.

1 Claim, 4 Drawing Sheets

SELF CLOSING INTERNAL HINGE

CROSS-REFERENCE TO RELATED APPLICATION

This application is a continuation-in-part of U.S. application Ser. No. 12/804,459 filed on Jul. 22, 2010.

BACKGROUND OF THE INVENTION

1. Field of the Invention

The invention is concerned with concealed internal hinges for self closing gates. In particular the present invention is concerned with inventive hinges that prevent bodily harm to fingers by not having pinch points. It is especially concerned with safety control gates at various work places and amusement parks. Typically these gates have ordinary hinges, which hinges can harm fingers when closed carelessly. The present invention, concealed or hidden internal hinge, prevents body harm by not having a pinch point which can physically smash fingers.

2. Description of the Related Art

Self-closing gates are a common everyday art. Some gates have springs or other resilient means that close the gate after it is opened. The problem of particular concern addressed by the present invention is that current control gates use hinges that can injure fingers, especially of small children. Such injuries can lead to unpleasant lawsuits. The present invention commercially available under the name "Phantom Hinge™" addresses this problem by having a hidden hinge within the safety control gate, which hidden hinge cannot cause body harm. An important feature of the present invention is that it opens and swings on a level plane and swings open to 120 degrees and is self closing.

SUMMARY OF INVENTION

Assembled self closing enclosed hinge 100, commercially available under name "Phantom Hinge" is connected with upper bend piece 305 and lower bend piece 315 of workpiece gate 301. The gate is opened as shown in the unlabeled upper illustration of FIG. 1 and hinge 100 shown as unassembled in FIG. 3. Upper bend piece 305 is connected with upper gate tube 303. Upper gate tube 303 fits over U-shaped tangs 321 with slot 323 of workpiece upper bend piece 305. These are commercial gate components. Workpiece lower bend piece 315 is identical to workpiece upper bend 305. U-shaped tangs 321 fit into first gate rotating connector piece 115 A and second gate-hinge rotating connector piece 115 K and are affixed by workpiece screws 335 through affixment holes 119 that passes through outer cylindrical surface into the cylindrical upper hollow core 117 into tapped screw hole 355 in U-shaped ends. In the instance of the present invention workpiece screws passes into flat plate 105 affixment hole 107 affixing internal axle 101 L. The force from opening of gate 301 by mechanical connection is transferred to flat plate affixment 105 of axle 101 L. As flat plate 105 is rotated that twisting is transferred via internal axle 101 L to secant cut 109. Secant cut 109 holds secant screw 310 M and transfers the opening gate motion to bushing 141 F. The rotating force is transferred to second straight end 139 of spiral spring 135 E placed into lower spring inlet 143 of bushing 141 F.

Bushing 141 F rotation is resisted by spiral spring 135 E because spring end 137 is placed by assembly into spring end inlet 129 on medial surface 130 of first stationary hinge part 123 C. Note axle 101 L holds assembly together as a unit.

Thus when workpiece gate 301 is opened it is urged back to closed position by self-closing inventive hinge 100.

DETAILED DESCRIPTION OF FIGURES

Figure 1:
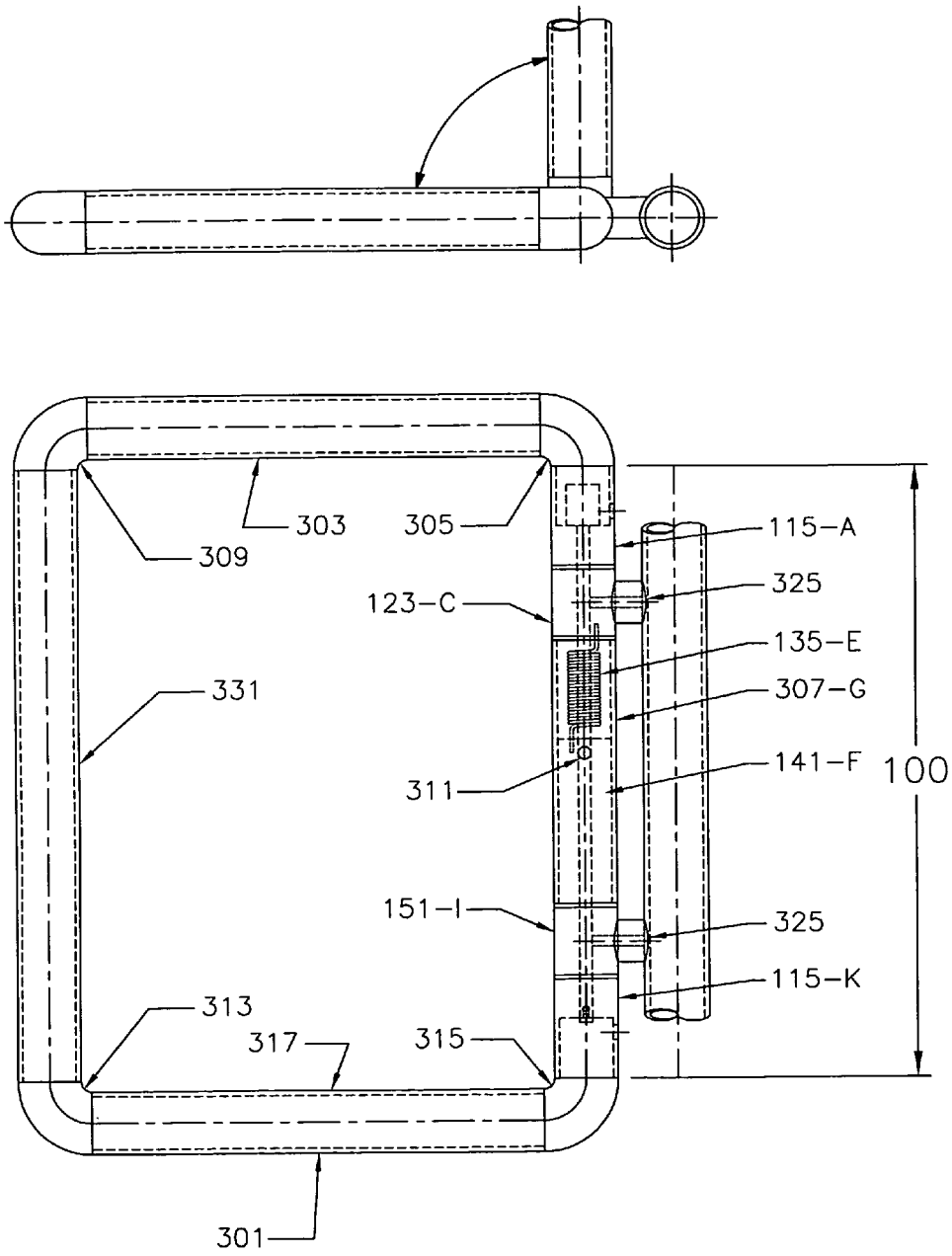
FIG. 1 shows workpiece control gate 301 with self-closing enclosed hinge 100.

FIG. 1 shows self-closing internal hinge 100 assembled with workpiece gate 301. Likewise it is common to the art that a simple barrier comprising of a simple tube (FIG. 4, 171) can be used for crowd control. Workpiece gate/barrier 301, which is affixed to one side of an entrance, has a workpiece upper bend piece 305. (It is to be noted that workpiece upper bend piece 305, workpiece upper outer bend piece 309, workpiece lower outer bend piece 313 and workpiece lower inner bend piece 315 are identical and are commercially available.) Upper bend piece 305 is connected with workpiece upper gate tube 303 which is connected in turn with workpiece upper outer bend piece 309. Workpiece upper outer bend piece 309 is attached to workpiece outer tube 331. Workpiece outer tube 331 is attached to workpiece lower outer bend piece 313 which in turn is attached with workpiece lower gate tube 317 to workpiece inner lower bend piece 315. Assembled workpiece gate 301 is connected to assembled hinge 100 by workpiece upper bend 305 and workpiece lower bend 315 of workpiece gate 301. Self-closing internal hinge 100 is attached to workpiece jam or post through workpiece gate mounts 325 by a first stationary hinge part 123 C and a second stationary hinge part 151 I.

Figure 2:
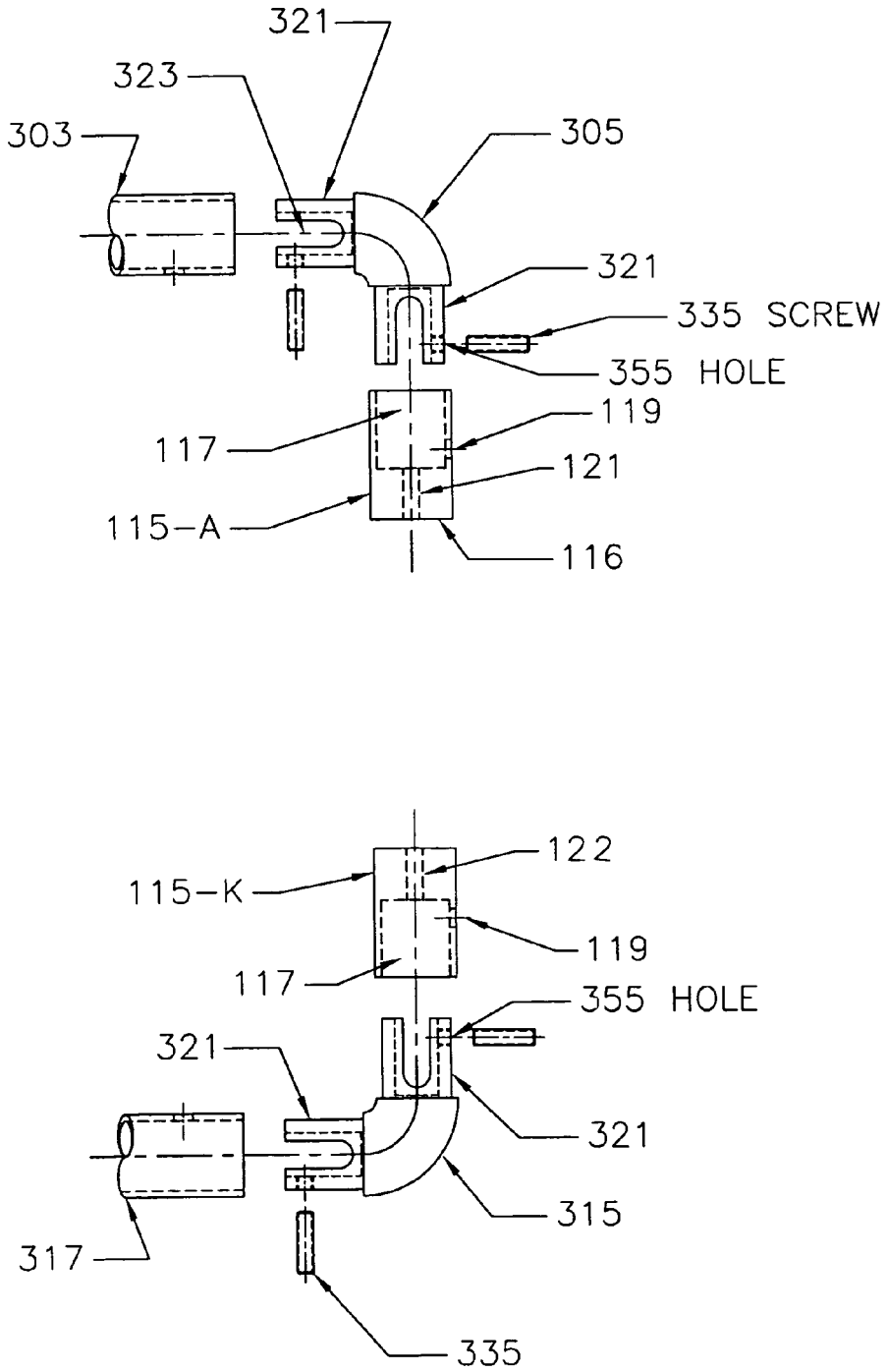
FIG. 2 shows an exploded view of how inventive first gate-hinge rotating connector piece 115 A and second gate-hinge rotating connector piece 115 K are affixed to workpiece upper bend 305 and workpiece lower bend 315 of workpiece gate 301.

FIG. 2 shows an exploded view of how workpiece gate 301 is affixed to inventive hinge 100. Workpiece lower bend piece 315 is identical to workpiece upper bend piece 305. U-shaped end 321 is bonded to upper gate tube 303 with screw 335. U-shaped end 321 fit into first gate rotating connector piece 115 A. Likewise, second gate-hinge rotating connector piece 115 K is affixed by workpiece screws 335 through affixment hole 119 that passes through outer cylindrical surface into the cylindrical lower hollow core 117 into tapped screw hole 355 in U-shaped ends 321. In the instance of the present invention workpiece screw 335 threads through workpiece upper bend 305 into flat plate 105 affixment hole 107 affixing internal axle 101 L so that it turns as workpiece gate 301 is rotated open.

Figure 3:
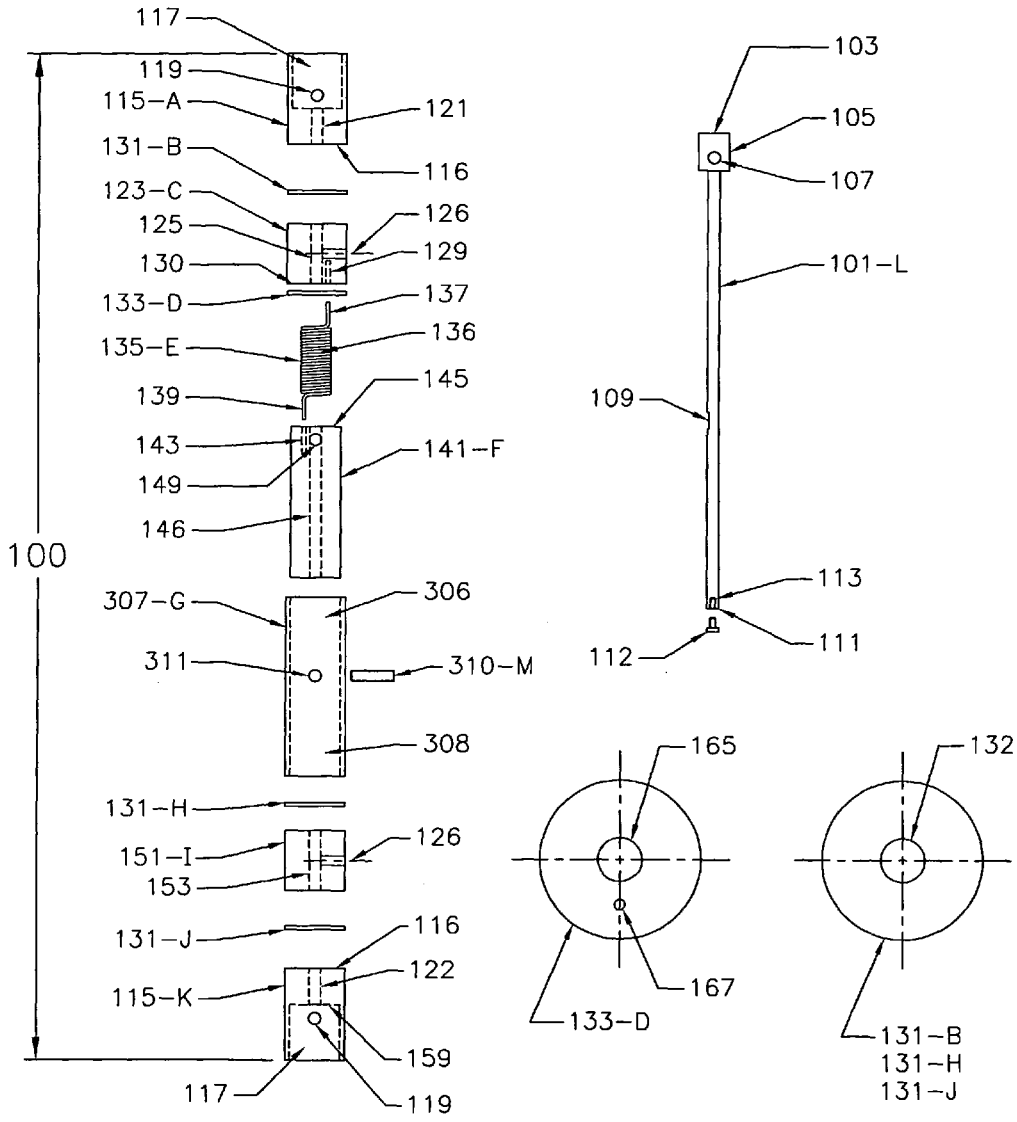
FIG. 3 shows the exploded self-closing internal hinge 100 and internal axle 101 L.

FIG. 3 shows parts of self-closing, enclosed hinge 100 exploded in sequence to show individual parts. It is a feature of this invention that it does not have a pinch point, It is to be noted that "first gate hinge rotating connector piece 115 A" is identical to "second gate-hinge rotating connector piece 115 K," that "first stationary hinge part 123 C" has an upper spring end inlet 129 on its medial surface 130 but otherwise is similar to "second stationary hinge part 151 I"; and that washers 131 B, 131 H and 131 J are also identical. While the inventive hinge 100 is shown in usual upright position, one should note that inventive hinge 100 would function if it were installed as a left hand gate or a right hand gate.

FIG. 3 shows first gate hinge rotating connector piece 115 A has a cylindrical upper hollow core 117 with affixment hole 119 that passes through outer cylindrical surface into the cylindrical upper hollow core 117 A axle passage 121 passes from that cylindrical upper hollow core 117 to medial base 116 of first gate-hinge connector piece 115 A. The first gate hinge rotating connector piece 115 A cylindrical hollow core 117 receives U-shaped ends 321 of workpiece upper bend 305 of workpiece gate 301 (see FIGS. 1 and 3). A first friction reducing washer 131 B has axle passage hole 132 and is placed between the first gate hinge rotating connector piece 115 A and a first stationary hinge part 123 C.

First stationary hinge part 123 C has a central tunnel 125 for internal axle 101 L and an affixment penetration 126 to attach to a workpiece gate mount 325 (see FIG. 1). The stationary hinge part 123 C has an upper spring end inlet 129 on its medial surface 130. Washer 133 D has larger axle passage hole 165 and a smaller hole 167 for first straight end 137 of spring 135 E. Spiral spring 135 E (a resilient means) has spiral hollow 136, a first straight end 137, and a second straight end 139.

Bushing 141 F has axle passage 146 through which passes internal axle 101 L. Bushing 141 F has a lower spring inlet 143 on its upper surface 145. Threaded tapped hole 149 in bushing 141 F receives secant screw 310 M which screw 310 M is urged into a secant cut 109 in mid part of axle 101 L.

Mid-section outer tubular section 307 G has an upper volume 306 and a lower volume 308. Bushing 141 F is placed in lower volume 308 and spiral spring 135 E is placed in upper volume 306 of outer tubular midsection 307 G. Screw 310 M passes through tubular section hole 311 in outer tubular section 307 G and threaded into tapped hole 149 of bushing 141 F. The length of screw 310 M in the preferred embodiment is such that it does not stick out into tubular section hole 311 allowing mid-section outer tubular section 307 G to be free floating. A second friction reducing washer 131 H with axle passage hole 132 is placed between mid-section outer tubular section 307 G and second stationary hinge part 151 I.

Second stationary hinge part 151 I has a central tunnel 153 for internal axle 101 L and an affixment penetration 126 to attach to a workpiece gate mount 325 (see FIG. 1). A third friction reducing washer 131 J with axle passage hole 132 is placed between second stationary hinge part 151 I and second gate-hinge connector piece 115 K.

Affixment hole 119 passes through outer cylindrical surface to cylindrical hollow core 117 to affix lower bend 315 of workpiece gate 301 (see FIGS. 1 and 3). Axle passage 122 passes from core 117 to medial base 116 passage terminus 159 of the second gate-hinge connector piece 115 K. Internal axle 101 L holds together self-closing enclosed hinge 100. Internal axle 101 L has a first end 103 with a flat plate 105. Flat plate 105 has hole 107 drilled through its approximate center. A secant cut 109 is cut into the mid part of axle 101 L. Second end 111 of axle 101 L has a tapped hole 113 to receive cap screw 112.

Inventive hinge 100 is assembled by inserting second end 111 of internal axle 101 L through axle passage 121 of first gate-hinge rotating connector piece 115 A, on through upper friction reducing washer 131 B, and central tunnel 125 of stationary hinge part 123 C. Friction reducing washer 133 D is placed between stationary hinge part 123 C and midsection outer tubular section 307 G.

First straight end 137 of spiral spring 135 E is inserted through friction reducing washer 133 D smaller hole 167 into upper spring end inlet 129 on medial surface 130 of stationary hinge part 123 C. The second straight end 139 of spiral spring 135 E is placed into lower spring inlet 143 of bushing 141 F.

Internal axle 101 L passes through spiral hollow 136 of spiral spring 135 E and axle passage 146 of bushing 141 F. Spiral spring 135 E is placed in upper volume 306 of outer tubular section 307 G and bushing 141 F is placed in lower volume 308 of mid section outer tubular section 307 G. Screw 310 M passes through outer tubular section 307 G hole 311, threaded through tapped hole 149 of bushing 141 F and urged into a secant cut 109 in the mid part of axle 101 L.

Internal axle 101 L further passes through second friction reducing washer 131 H on through central tunnel 153 of second stationary hinge part 151 I and through hole 132 of third friction reducing washer 131 J. Internal axle 101 L then passes through axle passage 122 into cylindrical lower hollow core 117 of said cylindrical hinge piece 115 K where internal axle 101 L stops at terminus 159 and receives cap screw 112 into tap hole 113 assembling self-closing internal hinge 100 as a unit.

Figure 4:
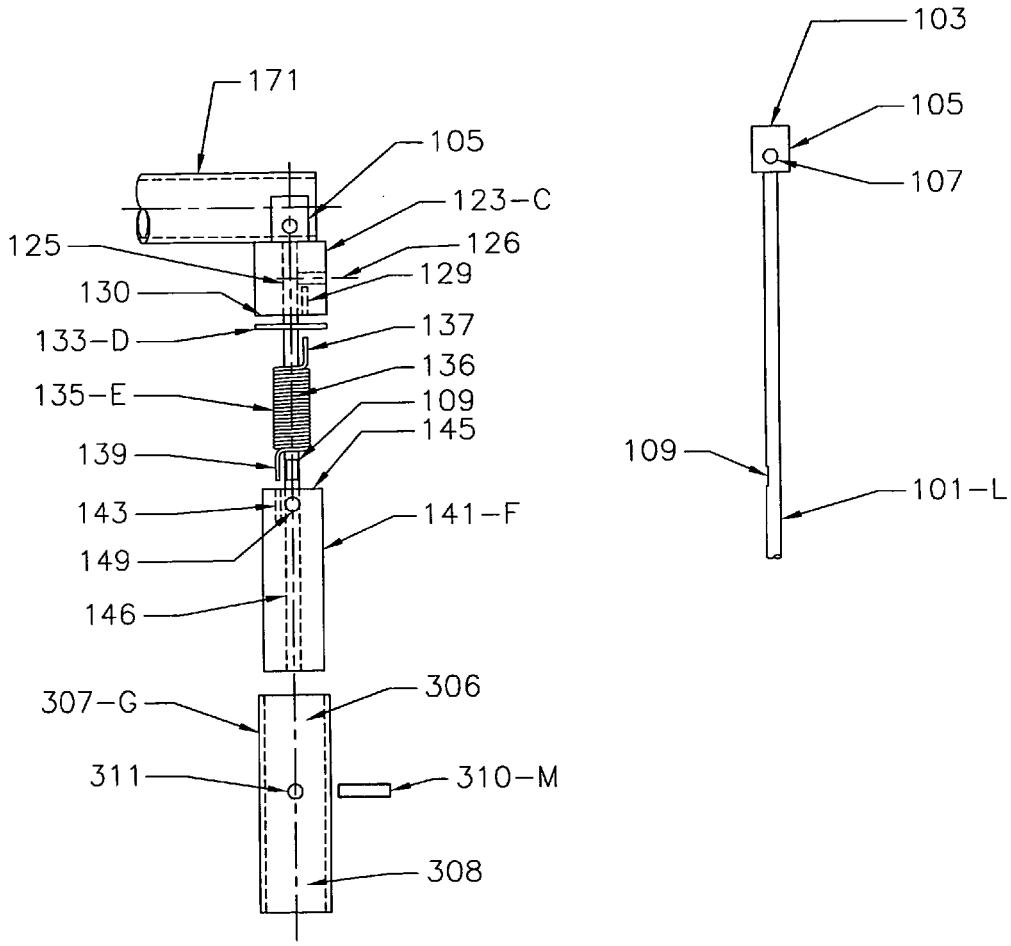
FIG. 4 shows a simplified embodiment of the invention, hidden hinge for a gate or barrier.

FIG. 4 shows a simplified embodiment of the invention for a hidden hinge for a barrier. This inventive hinge has no pinch point. Internal axel 101 L has a first end 103 with a flat plate 105. Flat plate 105 has hole 107 drilled through its approximate center. A secant cut 109 is cut into the mid part of axle 101 L.

First stationary hinge part 123 C has a central tunnel 125 and an affixment penetration 126 to attach to one side of a workpiece gate/entrance 325 (see FIG. 1). The stationary hinge part 123 C has an upper spring end inlet 129 on its medial surface 130. Washer 133 D has larger axle passage hole 165 through which passes internal axle 101 L and a smaller hole 167 for first straight end 137 of spring 135 E.

Spiral spring 135 E (a resilient means) has spiral hollow 136, a first straight end 137, and a second straight end 139.

Bushing 141 F has axle passage 146 through which passes internal axle 101 L. Mid-section outer tubular section 307 G has an upper volume 306 and a lower volume 308. Bushing 141 F is placed in lower volume 308 and spiral spring 135 E is placed in upper volume 306 of outer tubular midsection 307 G. Outer tubular section 307 G has a tubular section hole 311 through which screw 310 M passes. Screw 310 M is threaded into tapped hole 149 and forced into secant cut 109 of internal axle 101 L. The length of screw 310 M in this embodiment is such that it does stick out into tubular section hole 311 of mid-section outer tubular section 307 G holding outer tubular section in place when tapped hole [113] and cap screw [112] are not used. Internal axel 101 L holds embodiment of FIG. 4 together by flat plate 105 and screw 310 M urged into secant cut 109 in mid part of axle 101 L.

In this embodiment of the invention barrier bar 171 is affixed directly to internal axel 101 L with affixment hole 107.

I claim:

1. A self-closing internal hinge (100) comprising:

A. an internal axle (101L); said internal axle (101L) has a secant cut (109), a first end (103) with a flat plate (105), and a second end (111) with a tapped hole (113); said flat plate (105) has a hole (107);

B. a first gate-hinge connector piece (115A) which has a cylindrical hollow core (117) and an axle passage (121); said cylindrical hollow core (117) receives said flat plate (105); and said connector piece axle passage (121) receives said internal axle (101L);

C. a first washer (131B) which has axle passage hole (132) which receives said internal axle (101L);

D. a first stationary hinge part (123C) has a spring end inlet (129), an affixment penetration (126), and a central tunnel (125) which receives said internal axle (101L);

E. a washer (133D) with a smaller hole (167) and an axle passage hole (165) which receives said internal axle (101L);

F. a spiral spring (135E) with a first straight end (137) and a second straight end (139); said first straight end (137) passes through said smaller hole (167) and is placed into said spring end inlet (129) of said first stationary hinge part (123 C); said internal axle (101L) passes through said spiral spring (135E);

G. a bushing (141F) has a tapped hole (149) and lower spring inlet (143); said lower spring inlet (143) receives said second straight end (139) of said spiral spring (135E); and a bushing axle passage (146) which receives said internal axle (101L);

H. an outer tubular midsection (307G) with a passage hole (311) having an upper volume (306) and a lower volume (308); said spiral spring (135E) is received in said upper volume (306); said bushing (141F) is affixed in said lower volume (308) by a secant screw (310 M) passing first through said passage hole (311) and threaded into said tapped hole (149) of said bushing (141F) and urged into said secant cut (109) of said internal axle (101L);

I. a second washer (131H) which has a hole (132) which receives said internal axle (101L);

J. a second stationary part (151I) has an affixment penetration (126) and a central tunnel (153) which receives said internal axle (101L);

K. a third washer (131J) which has a hole (132) which receives said internal axle (101L);

L. a second gate rotating connector piece (115K) which has an axle passage (121) which receives said internal axle (101L); and a second gate rotating connector piece cylindrical hollow core (117) which receives said second end (111) of said axle (101L);

said second end (111) with said tapped hole (113) receives cap screw (112); said screw cap (112) retains said self-closing internal hinge (100) as a unit.

* * * * *